United States Patent [19]

Misaka et al.

[11] 4,296,864

[45] Oct. 27, 1981

[54] AIR CLASSIFIER

[75] Inventors: Takaaki Misaka, Koganei; Takeshi Furukawa, Kawasaki; Eiichi Onuma, Narashino, all of Japan

[73] Assignee: Onoda Cement Co., Ltd., Japan

[21] Appl. No.: 167,048

[22] Filed: Jul. 9, 1980

[30] Foreign Application Priority Data

Jul. 17, 1979 [JP] Japan ..... 54/89793
Jul. 17, 1979 [JP] Japan ..... 54/89794

[51] Int. Cl.[3] ..... B04C 5/103

[52] U.S. Cl. ..... 209/144; 209/148; 209/154

[58] Field of Search ..... 209/144, 211, 148, 154; 55/459 R, 459 C, 459 D; 210/512 R, 512 M

[56] References Cited

U.S. PATENT DOCUMENTS

| | | | |
|---|---|---|---|
| 2,753,996 | 7/1956 | Kaiser | 209/144 X |
| 3,015,392 | 1/1962 | Rozsa et al. | 209/144 |
| 3,040,888 | 6/1962 | Hosokawa et al. | 209/144 |
| 3,423,034 | 1/1969 | Hippert | 209/144 X |
| 3,669,265 | 6/1972 | Conley | 209/144 |
| 3,670,886 | 6/1972 | Hosokawa et al. | 209/144 X |

*Primary Examiner*—William A. Cuchlinski, Jr.
*Attorney, Agent, or Firm*—Schwartz, Jeffery, Schwaab, Mack, Blumenthal & Koch

[57] ABSTRACT

An air classifier comprises a casing formed of a generally hollow cylindrical vertical casing body and an inverted conical hopper fixed to the lower wall of the casing body. A fine product outlet duct is provided at the center of the upper wall of the casing body. An air-powdered material inlet duct and a secondary air inlet duct are set in the diametrically opposite positions of the vertical wall of the casing body to project tangentially outward. A vertical rotary shaft extends through the central portion of the casing body. A rotary disc member for concurrently carrying out the dispersion and classification of a powder raw material is fitted to the lower end of the rotary shaft at a boundary between the casing body and hopper. A cage-shaped assembly of guide vanes is provided in the casing body to conduct a mixture of air and powdered material into the casing body. The air classifier of this invention constructed as described above can precisely classify by itself a large amount of powder material as a classifier for swept-air from a mill.

31 Claims, 15 Drawing Figures

AIR CLASSIFIER

This invention relates to an air classifier of a powder material and more particularly to an air classifier for classifying powdered cement into a fine and coarse powder.

In the grinding process of a cement manufacturing plant, there has been established a closed circuit grinding system which consists of a tube mill and an air separator cooperating therewith. In the grinding process, a considerable amount of electric power is consumed. For reduction of such electric power consumption, various attempts have been made for improvement in the grinding and classifying efficiencies. Among them, an attempt to let a larger amount of air pass through a mill is a useful means. Hitherto, an amount of air which is to be conducted through a mill has been restricted only to such an extent as is necessary to suppress the emission of dust from the mill. However, a process intended to increase the so-called air-sweeping effect in which air is positively let to flow in an amount several times larger than has formerly been applied for the above-mentioned object has the advantages of increasing the cement-cooling efficiency, preventing the over-grinding of cement, and suppressing the adhesion of cement powder on small balls, and consequently improving the cement-grinding efficiency and saving electric power required for cement grinding.

In this case, however, a larger amount of coarse cement powder is carried into an exhaust air, making it necessary to additionally provide a classifier for swept-air from a mill. A dispersion type air separator equipped with a circulation fan and external cyclones widely accepted in the cement-manufacturing industry are generally used for classification of cement powder which is not treated by the aforesaid air-sweeping process. Therefore, in this case a classifier for swept-air from a mill has to be additionally provided in order to carry out the more precise classification of cement powder. In this connection, the ordinary cyclone may be regarded as available for use as such a classifier. To date, the ordinary cyclone has been widely applied for collection of dust. Where, however, a higher accuracy of classification is not demanded, the ordinary cyclone is also applicable as a classifier. In this case, the size of classification of cement powder is generally determined by the size of the cyclone within the range of 1 to 20 micrometers, and one cyclone cannot be used to classify cement powder according to the desired sizes. For the concentration (or powder density) more than 0.1 $Kg/m^3$, the cyclone provides insufficient dispersion, resulting in a decline in classification accuracy. Where the classification range is required to be more than the above range or the classification according to different sizes of powder with one classifier is needed, it is unadvisable to apply the ordinary cyclone as a classifier. If the ordinary cyclone is used as a classifier for swept-air from a mill when the air-sweeping effect is increased, fine powder usable as cement product will be considerably carried with coarse powder. An attempt to send a mixture of fine and coarse powder back to a mill as a return for regrinding is considerably inefficient and uneconomical, and noticeably decreases an advantage derived from the intensification of the air-sweeping effect.

It is an object of this invention to provide an air classifier which is freed of the drawbacks of the previously described cyclone and can precisely classify a large amount of powdered material containing a high concentration of dust.

To attain the above-mentioned object, this invention provides an air classifier which includes:

a casing comprising a substantially hollow cylindrical vertical casing body and a conical hopper disposed at the lower end of the casing body;

a fine product outlet duct set at the center of one end of the casing body;

an air-powder raw material inlet duct tangentially projecting from the lateral wall of the casing body;

a vertical rotary shaft concentrically extending through the casing body;

a rotary disc member concentrically mounted on the rotary shaft and concurrently carrying out the dispersion and classification of powdered raw material; and guide vanes provided in the casing body in a state spaced from each other circumferentially of the casing body to conduct air and powdered raw material into the casing body.

The air classifier of this invention constructed as described above acts as a classifier for dust-laden swept-air from a mill, and has the ability of precisely classifying by itself a large amount of powdered material conducted with air after the intensification of the air-sweeping effect.

A plurality of vortical flow-adjusting blades fixed at one end to the rotary disc may be provided in the casing body in a state set parallel with the rotary shaft and spaced from each other in the circumferential direction of the rotary disc member. The vortical flow-adjusting blades suppress the occurrence of disturbances in the vortical flow of air-powdered raw material mixture in the casing body, thereby increasing the classification efficiency of the air classifier.

Further, it may provide one or more horizontal ring-shaped partition members in the casing body in a concentrical relationship with the central shaft. These partition members more effectively prevent the occurrence of disturbances in the vortical flow of air and powdered raw material, thereby further promoting the classification efficiency of the air classifier.

It may provide a powdered raw material inlet at the top of the casing body and also a dispersion plate member at the lowermost part of the powdered raw material inlet formed in the casing body. This arrangement ensures the capability of classification of a large amount of powder material. In particular, this arrangement makes it possible to treat both swept-air from the mill of high solid concentration and material separately discharged from a mill are treated in the same classifier.

This invention can be more fully understood from the following detailed description when taken in conjunction with the accompanying drawings, in which.

Figure 10:
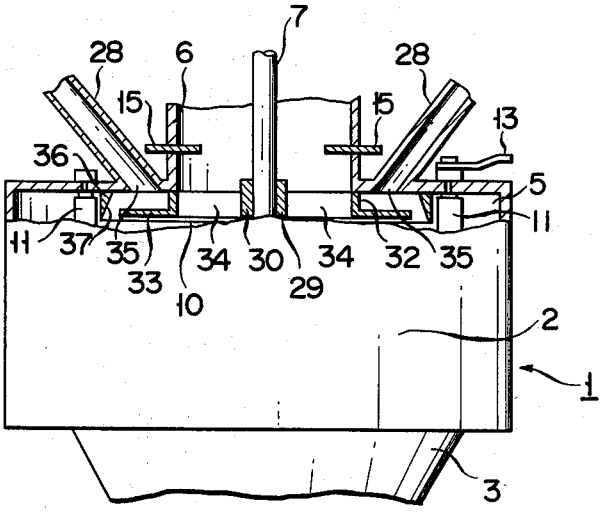
FIG. 10 is a fractional side elevational view partly in section of an air classifier according to still another embodiment of the invention.
Figure 14:
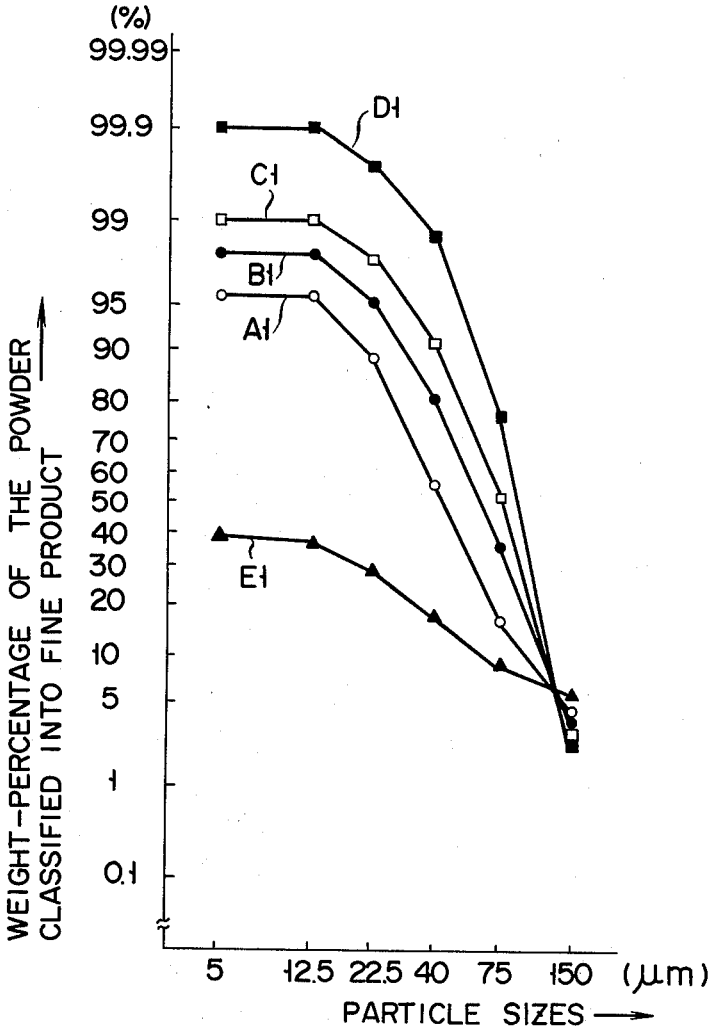
Figure 15:
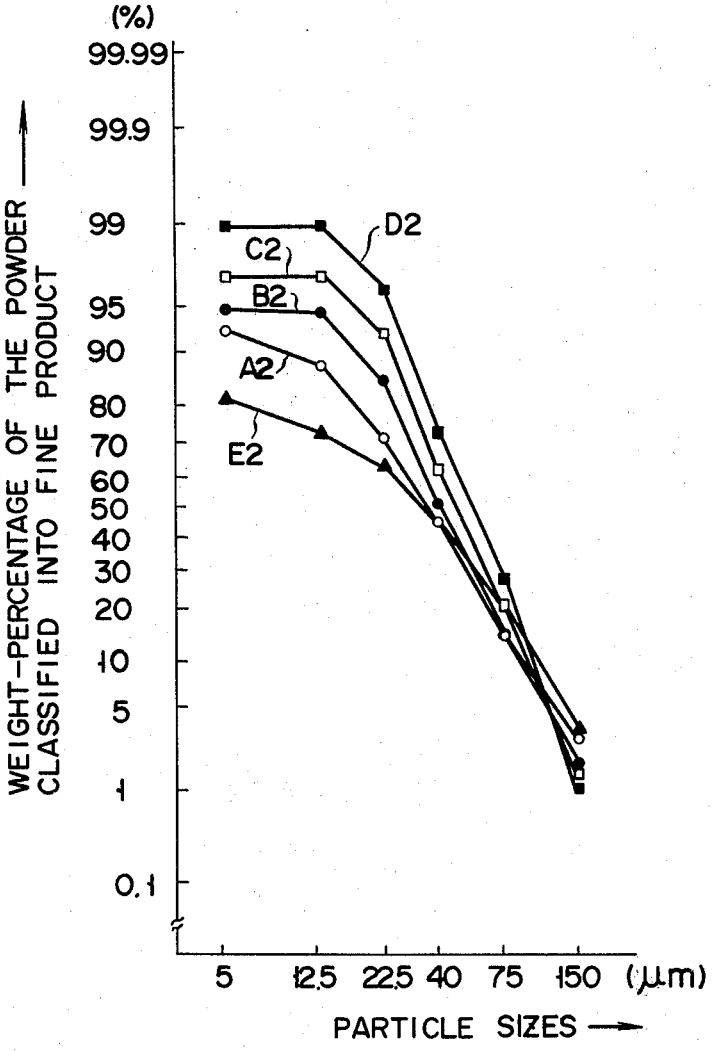

FIG. 14 graphically shows the classifying characteristic of the air classifier of FIGS. 1 to 4; and FIG. 15 graphically indicates the classifying characteristic of the air classifiers of FIGS. 1 to 4 when fitted with the arrangement of FIG. 10.

Figure 1:
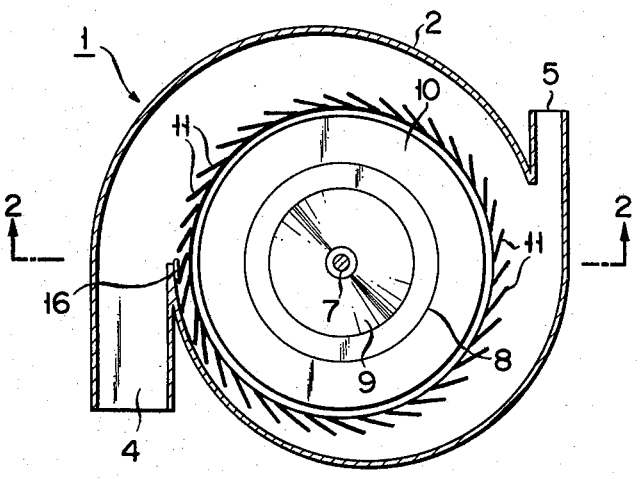
FIG. 1 is a horizontal cross-sectional view of an air classifier according to one embodiment of this invention.
Figure 2:
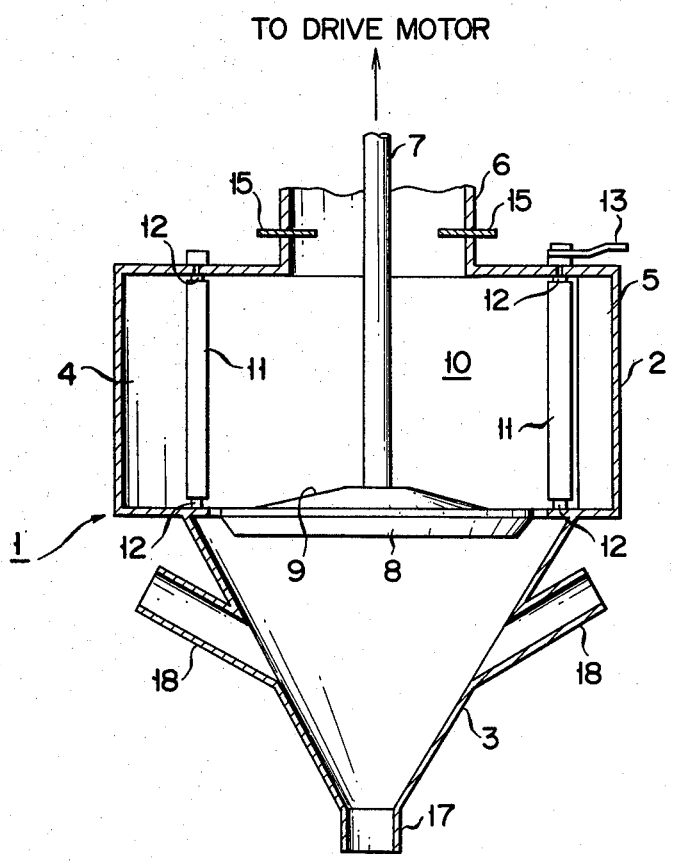
FIG. 2 is a sectional view on line 2—2 of FIG. 1.

Referring to FIGS. 1 and 2, a casing 1 of an air classifier embodying this invention comprises a hollow vertical casing body 2 fabricated by assembling two components substantially semicircular in cross section in a mutually displaced relationship and a conical hopper 3 (FIG. 2) fixed to the lower end of the casing body 2. An air-powder raw material inlet duct 4 projects outward from the lateral wall of the casing body 2 in a tangential direction (FIG. 1). A secondary air inlet duct 5 projects tangentially outward from the diametrically opposite lateral wall of the casing body 2 to the air-powder raw material inlet duct 4. A hollow cylindrical fine product outlet duct 6 (FIG. 2) extends upward from the central portion of the upper wall of the casing body 2.

A vertical rotary shaft 7 extends through the central part of the fine product oulet duct 6 and casing body 2. The vertical rotary shaft 7 has its upper end fixed to a drive motor such as an electric motor or hydraulic motor to be rotated thereby.

A horizontal rotary disc member 8 concurrently carrying out the dispersion and classification of a powdered raw material is concentrically fixed to the lower end of the vertical rotary shaft 7 with the outer periphery of the rotary disc member 8 disposed substantially at a boundary between the casing body 2 and hopper 3. The upper surface 9 of the rotary disc member 8 takes an appreciably flattened truncated conical shape. Therefore, the rotary disc member 8 not only ensures the smooth dispersion and classification of a powder raw material, but also prevents fine powder from being deposited on the conical surface of the rotary disc member 8.

Figure 3:
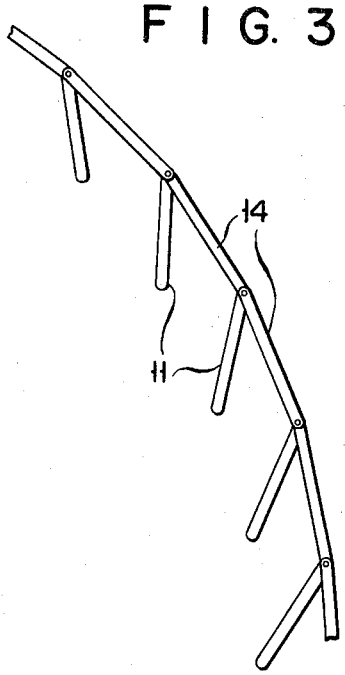
FIG. 3 is a partial plan view of a guide vane-operating mechanism used with the air classifier of FIG. 1.

The central space of the casing body 1 constitutes a classification chamber 10 communicating with the air-powder material inlet duct 4, secondary air inlet duct 5, fine product outlet duct 6. A plurality of vertically extending guide vanes 11 are provided in the classification chamber 10 in parallel with the vertical rotary shaft 7 in a state equidistantly spaced from each other along the circumference of an imaginary circle centered at the rotary shaft 7. The guide vanes 11 are rotatably supported on the upper and lower walls of the casing body 2 by means of bearings 12. Levers 13 are mounted on those upper ends of some of the guide vanes 11 which project upward from the upper wall of the casing body 2. The movement of the lever 13 adjusts the angle which the guide vanes 11 make with planes including the axis of the rotary shaft 7 and the rotating axes of the respective guide vanes 11. Where the guide vanes 11 fixed by the levers 13 are rotated about the rotating axis lying on the center line or inner edge thereof, all the guide vanes 11 are interlocked with one after another by connecting the adjacent outer edges of the guide vanes 11 by the links 14(FIG. 3). Where the guide vanes 11 fixed by the levers 13 are rotated about the rotating axis lying on the vertical center line or outer edge thereof, all the guide vanes 11 interlocked with one after another by connecting the inner edges of the adjacent guide vanes 11 by the links 14 are also rotated.

Referring to FIG. 2, the fine product outlet duct 6 is provided with adjustable dampers 15. The extent to which the dampers 15 are inserted into the fine product outlet duct 6 adjusts the cross sectional area of the opening of the duct 6, thereby increasing the accuracy with which classified powder sizes are adjusted, that is, the accuracy of classification.

A pocket 16 (FIG. 1) is provided in that part of the casing body 2 which is disposed adjacent to the air-powder material inlet duct 4 and downstream of the air flow in the casing body 2 in order to prevent coarse powder from being carried back toward the inlet duct 4.

The lower end of the hopper 3 is fitted with a coarse powder outlet 17. The lateral wall of the hopper 3 is provided with tertiary air inlet ducts 18.

In operation, the vertical rotary shaft 7 and horizontal rotary disc member 8 are jointly rotated clockwise of FIG. 1 by the drive motor. On the other hand, a powder raw material to be classified is supplied to the classification chamber 10 from the air-powder raw material inlet duct 4 at a proper speed. In this case, the powder raw material is vortically carried into the classification chamber 10, with the flowing direction of the powder raw material defined by the guide vanes 11 inclined at a proper angle. Where, at this time, the ratio of an introduced amount of the powdered raw material to a supplied amount of air (hereinafter referred to as "powdered material density") is excessively large, an additional amount of air is taken in through the secondary air inlet duct 5 to make up for the deficiency of air, thereby controlling the powder material density to ensure the accurate classification. A mixture of the powder raw material and air vortically carried into the classification chamber 10 increases in rotational speed by the action of the rotary disc member 8. At this time the mixture undergoes two forces acting in the opposite directions at the same time, that is, a centrifugal force and the air resistance acting inwardly in the radial direction. As used herein, the size of the powder of the powder raw material about which the two forces are kept in good balance is referred to as "a cut size." Finer powder than the powder of cut size undergoes an inward acting air resistance rather than the centrifugal force, and consequently is carried toward the center of the classification chamber 10 by being borne on air streams. Thus, the fine powder is conducted into the fine product outlet duct 6 and thereafter collected by a separately provided collector (not shown). In contrast, coarser powder is subject to a centrifugal force rather than an inward acting air resistance, and consequently flows down the inner walls of the guide vanes 11 to fall into the hopper 3. Further, part of coarse powder is brought to the pocket 16, from which they are quickly let to fall into the hopper 3. Coarse powder gathered in the hopper 3 is recovered through the coarse powder outlet 17 by means of a rotary valve (not shown). Air streams brought into the hopper 3 through the tertiary air inlet ducts 18 scatter fine powder mixed with coarse powder carried into the hopper 3 by being deposited on coarse powder. The scattered fine powder is sent back to the classification chamber 10 lying above the hopper 3 for reclassification in order to increase the classification accuracy.

Figure 4:
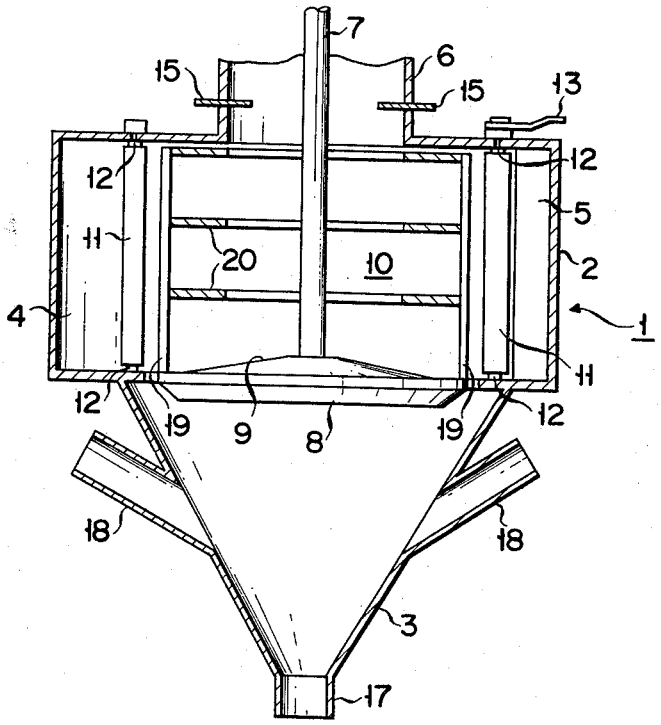
FIG. 4 is a longitudinal sectional view of an air classifier according to another embodiment of the invention.

Description is now given of an air classifier of FIG. 4 according to another embodiment of this invention. With this embodiment, the rotary disc member 8 of the air classifier of FIGS. 1 to 3 is further provided with a plurality of vortical flow-adjusting blades 19. The vortical flow-adjusting blades 19 are fitted with partition members 20, thereby dividing the classification chamber 10 into a plurality of compartments. The vortical flow-adjusting blades 19 are vertically extending plate members, which are set in parallel with the vertical rotary shaft 7 and arranged equidistantly along the circumference of the rotary disc 8. The partition members 20 are ring-shaped and connected to the vortical flow-adjusting blades 19 at the periphery in a concentric relationship with the rotary shaft 7.

Air streams carrying powdered raw material flow into the classification chamber 10 in a vortical state rotating from the periphery toward the center of the classification chamber 10. When the sizes of the conventional classifiers become large, the generation of an ideal vortical flow is theoretically difficult. Disturbances tend to occur in a vortical flow, no matter how a rotational speed of the rotary disc member 8, a supplied amount of powder raw material and its powder size distribution are controlled. Accordingly, it is impossible to expect high classification accuracy.

On the contrary, the arrangement of FIG. 4 is particularly adapted for a large size air classifier, and can classify a large amount of powder raw material with high accuracy. In other words, application of the vortical flow adjusting blades 19 and partition members 20 prevents disturbances from arising in the vortical flow, as later detailed, even in a large size air classifier, and can classify a large amount of powder raw material with high accuracy.

The vortical flow-adjusting blades 19 divide the cross sectional area of an incoming powder material into vertically extending blocks, thereby suppressing the generation of disturbances in the vortical flow on the same horizontal plane of the powder raw material into the classification chamber 10 and also adjusting the cut size. A number of vortical flow-adjusting blades 19 to be used and their arrangement on the rotary disc member 8 are defined by the desired cut size, the capacity of an air classifier, the rotational speed of the rotary disc member 8 and other associated factors. The cut size generally becomes smaller, as the vortical flow-adjusting blades 19 are arranged nearer to the periphery of the rotary disc member 8.

Figure 5:
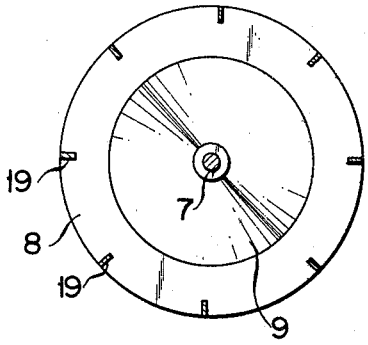
FIG. 5 is a plan view showing the arrangement of the vortical flow-adjusting blades used with the air classifier of FIG. 4.
Figure 6:
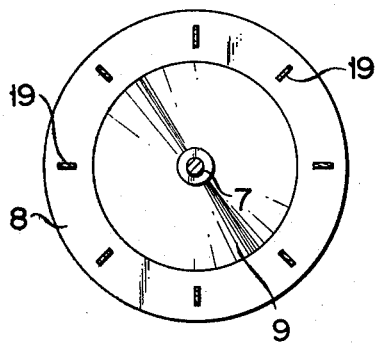
FIGS. 6 and 7 are plan views showing the arrangements of the modifications of the vortical flow-adjusting blades of FIG. 5.
Figure 7:
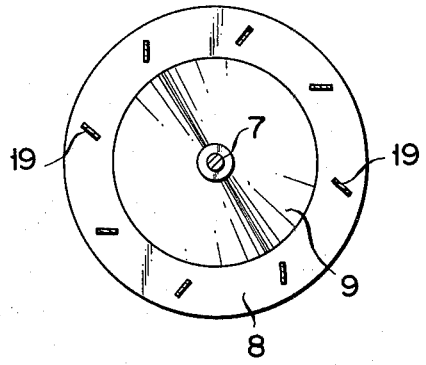

FIGS. 5 to 7 show the various arrangements of the vortical flow-adjusting blades 19. In FIG. 5, the vortical flow-adjusting blades 19 are set closest to the periphery of the rotary disc member 8, thereby ensuring the finest cut size. In FIG. 6, the vortical flow-adjusting blades 19 are disposed appreciably inward from the peripheral edge of the rotary disc member 8, thus producing an intermediate cut size. In FIG. 7, the position of the vortical flow-adjusting blades 19 on the rotary disc member 8 does not much differ from their position shown in FIG. 6. In FIG. 7, however, the vortical flow-adjusting blades 19 are inclined with respect to planes including the axis of the rotary shaft 7 and the vertical center of the respective blades 19, though, in FIGS. 5 and 6, the vortical flow-adjusting blades 19 are all directed toward the rotary shaft 7. The inclination angle defined by the vortical flow-adjusting blades of FIG. 7 can be variable. The selection of the indication angle of the vortical flow-adjusting blades of FIG. 7 controls the direction in which the vortical flow of a powder raw material is directed. The cut size is defined by a combination of the indication angle and position of the vortical flow-adjusting blades 19.

The partition members 20 vertically divide that portion of the classification chamber 10 which lies close to the outer edge thereof. This arrangement prevents the gravitational fall of powder raw material, thereby suppressing the occurrence of variation in the overall density of the powder raw material throughout the classification chamber 10. In other words, the powder raw material of substantially the same density runs in any horizontal vortical flow, throughout the classification chamber 10. Therefore, the partition members 20 minimize changes in the vertical component speed of a vortical flow, thereby increasing the classification accuracy. The number of the partition walls is selected in accordance with the desired cut size and the classification accuracy. Application of the partition members 20 makes it possible to design an air classifier which can fully cope with limitations, for example, on the location where an air classifier is to be installed and an area occupied thereby. Moreover, provision of the partition members 20 ensures a fully high classification accuracy, even without appreciably increasing the capacity of an air classifier relative to an amount of powder raw material to be treated, thus offering great economic advantages.

The air classifier of FIG. 4 according to another embodiment of this invention which has the previously described arrangement and function is adapted to accurately classify a powder raw material contained in a dust-laden air which is introduced after the more vigorous sweeping of air from a mill used in a cement manufacturing system. However, the arrangement of FIG. 4 is further applicable to any other type of air classifier of a powder raw material.

The arrangement of FIG. 4 can control the cut size by adjusting the speed at which a powder raw material is introduced into the classification chamber 10; the inclination angle of the guide vanes 11; the rotational speed of the rotary shaft 7; the direction in which the powder raw material makes a vortical flow; an amount of air introduced into the classification chamber 10 through the secondary air inlet ducts 1 and the tertiary air inlet ducts 18; the extent to which the dampers 15 are inserted into the fine product outlet duct 6 to restrict the size of its opening; and the manner in which the vortical flow-adjusting blades 19 and partition members 20 are set in place. The arrangement of FIG. 4 can classify a powder raw material wherein the cut sizes of classification extend over a broad range of scores of micrometers to thousands of micrometers by the synergetic effect derived from the combination of the above-listed cut size-controlling factors.

Figure 8:
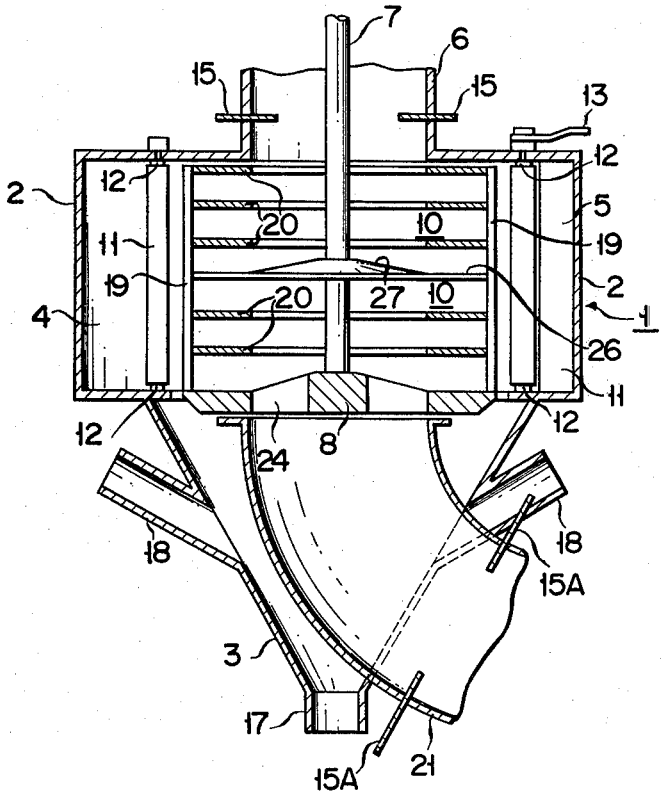
FIG. 8 is a longitudinal sectional views of air classifiers according to another embodiment of the invention.

Description is now given of an air classifier of FIG. 8 according to a further embodiment of this invention. An additional horizontally set central rotary disc member 26 is concentrically disposed on the vertical rotary shaft 7 at half the height of the classification chamber 10 to divide this chamber 10 into two upper and lower sections. The additional rotary disc member 26 is connected at the peripheral edge to the vortical flow-adjusting blades 19. Like the rotary disc member 8 of FIG. 4, the additional rotary disc member 26 has an appreciably flattened conical surface 27 to concurrently carry out the smooth dispersion and classification of a powder raw material in the upper section of the classification chamber 10. The upper and lower sections of the classification chamber 10 are provided with ring-shaped horizontal partition members 20 having the same construction as those of FIG. 4. The rotary disc member 8 fixed to the lower end of the rotary shaft 7. A fine product outlet duct 21 is concentrically fitted to the lower surface of the rotary disc member 8.

Figure 9:
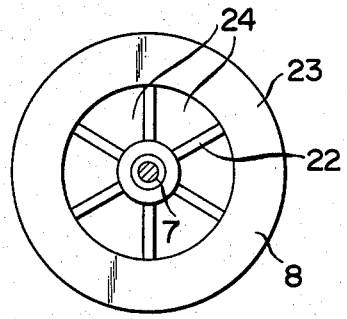
FIG. 9 is a plan view of a rotary disc member used with the air classifiers of FIG. 8.
Figure 11:
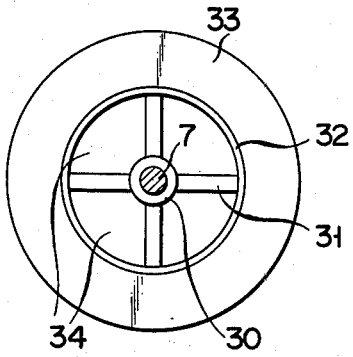
FIG. 11 is a plan view of a dispersion plate member used with the air classifier of FIG. 10.

A rotary disc member 8 is concentrically fixed to the lower end of a rotary shaft 7 and consists of radial yokes 22 and a rim 23 which define openings 24 (FIG. 9). Disposed below the rotary disc member 8 is a fine product outlet duct 21 having one end set concentrically with the member 8 and the other end drawn out of a hopper 3. The duct 21 communicates with a classification chamber 10 through the openings 24 in the rotary disc member 8. The duct 21 has also adjustable dampers 15A.

A fine powder raw material classified in the upper section of the classification chamber 10 is sucked out through the upper fine product outlet duct 6. A fine product classified in the lower section of the classification chamber 10 is drawn out through the lower fine product outlet duct 21. Since the central rotary disc member 26 divides the classification chamber 10 into two sections each occupying substantially half the volume of the classification chamber 10, variations in the vertical component speed of a vortical flow of a powder raw material previously described in connection with the air classifier of FIG. 4 can be further reduced, more increasing the classification accuracy than in the embodiment of FIG. 4.

Description is now given of an air classifier of FIG. 10 according to a still further embodiment of this invention. A plurality of (for example, four) additional powdered raw material inlet ducts 28 are provided on the upper wall of the casing body 2 of the embodiments of FIGS. 1 to 3, 4 and 8. The powder raw material inlet ducts 28 surround the fine product outlet duct 6 and are equidistantly arranged along the periphery of an imaginary circle centered at the rotary shaft 7.

A horizontal dispersion member 29 is mounted on the upper portion of the classification chamber 10 in a state fixed to the rotary shaft 7. The dispersion member 29 comprises a boss 30, hollow cylindrical section 32 concentrically connected to the boss 30 by means of yokes 31, and ring-shaped flange 33 projecting radially outward from the lower end of the hollow cylindrical section 32. The dispersion member 29 is provided at the center with an openings 34 through which the classification chamber 10 except for the boss 30 and yokes 31 communicates with the fine product outlet duct 6. The hollow cylindrical section 32 has substantially the same inner diameter as the fine product outlet duct 6, and also a sufficient length to occur the ring-shaped flange 33 to be spaced for a prescribed distance from the underside of the upper wall of the casing body 2, and acts to shut off the classification chamber 10 from the powdered raw material inlet duct 28.

The ring-shaped flange 33 extends to the lowermost region of an opening 35 provided at the lower end of the powder raw material inlet ducts 28 for communication with the casing body 2. The flange 33 traps powder raw material falling off the powder raw material inlet duct 28, thereby preventing the powder raw material from being directly carried into the classification chamber 10.

A buffer member 36 whose inner wall defines a truncated conical form is concentrical with the rotary shaft 7 and is fixed to the underside of the upper wall of the casing body 2. The buffer member 36 surrounds the cylindrical section 32 of the dispersion member 29 and ring-shaped flange 33.

A powder raw material introduced through the powder raw material inlet duct 28 falls on the ring-shaped flange 33. When the dispersion member 29 is rotated jointly with the rotary shaft, the fallen powder raw material is dispersed and strikes against the truncated conical shaped inner wall 37 of the buffer member 36 and is diverted into the classification chamber 10, and finally mixed with a mixture of air and powder raw material brought in through the air-powder material inlet duct 4, thereby increasing the amount of classified powder.

Figure 12:
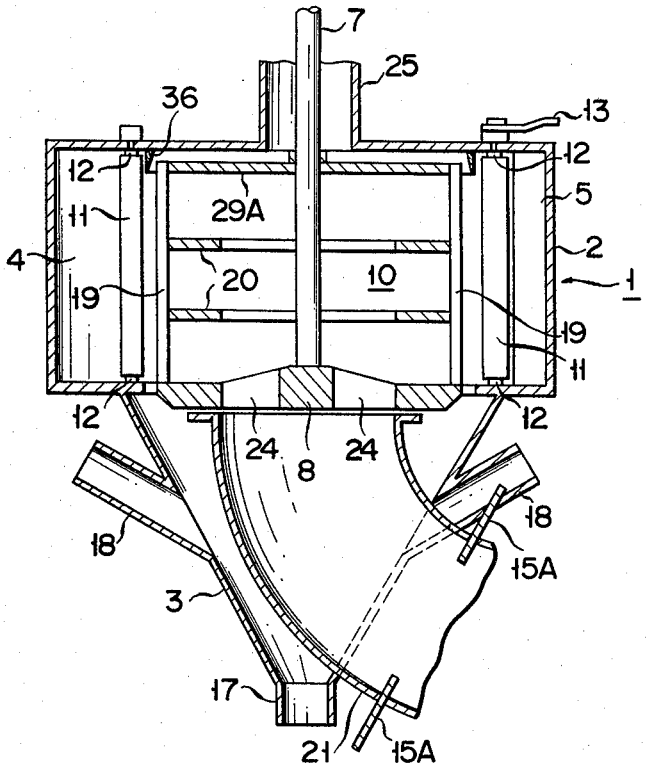
FIG. 12 is a longitudinal sectional view of an air classifier according to a further embodiment of the invention.
Figure 13:
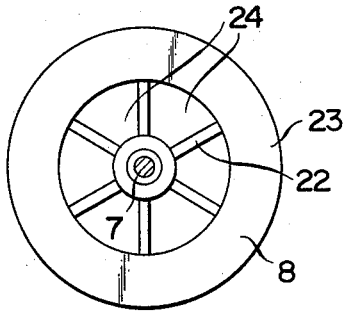
FIG. 13 is a plan view of a rotary disc member of FIG. 12.

With another embodiment of FIG. 12, a disc-like horizontal dispersion member 29A is fixed to the upper ends of the vortical flow-adjusting blades 19 erected on a rotary disc member 8 having the same construction of that of FIG. 9 (FIG. 13). The member 29A is also concentrically fixed to the rotary shaft 7. A buffer member 36 having the same construction as that of FIG. 10 is disposed under the upper wall of the casing body 2 so as to surround the dispersion member 29A. Disposed between the dispersion member 29A and the rotary disc member 8 are ring-shaped partition members 20 substantially equally spaced from each other and connected at their outer periphery to the blades 19. A powdered raw material inlet duct 25 projects upward from the central part of the upper wall of the casing body 2 and allows the rotary shaft 7 to extend therethrough. A fine product outlet duct 21 having adjustable dampers 15A is concentrically disposed under the rotary disc member 8 like the outlet duct 21 of FIG. 8. Like the embodiment of FIG. 10, an additional powder material can be added to the mixture from the powder material inlet duct 25 through the dispersion member 29A and the buffer member 36 in order to adjust the ratio in which the powder material and air are mixed. The classified powder material is sucked out of the classification chamber 10 through the openings 24 of the rotary disc member 8 and fine product outlet duct 21, ensuring the same effect as is realized by the arrangements of FIG. 10.

The powder material is introduced into the casing body 2 only through additional powder raw material inlets 28 or inlet 25 such that an ordinary classification can be carried out as is done by an ordinary mill.

Description is now given of the examples in which air classifiers according to the previously described embodiments of this invention were applied.

EXAMPLE 1

A mixture of cement powder and air recovered from a cement mill using air sweeping process was used as a raw material of classification. This raw material has a powder size distribution as shown in Table 1 below.

TABLE 1

| Particle size (micrometers) | 10 | 15 | 30 | 50 | 100 | 200 |
|---|---|---|---|---|---|---|
| Weight percentage | | | | | | |

TABLE 1-continued

| | | | | | | |
|---|---|---|---|---|---|---|
| of sieve residue | 77.9 | 69.0 | 48.5 | 30.6 | 14.6 | 10.0 |

Air classifiers shown in FIGS. 1 to 4 were used in the experiments. The classification chamber had a diameter (or the outer diameter of the rotary disc member 8) of 1,600 mm, and a height of 1,000 mm (a height from the peripheral edge of the rotary disc member 8 to the underside of the upper wall of the casing body 2), and was provided with 60 guide vanes 11 which had a width of 50 mm and whose inclination angle was variable. The ordinary cyclone was used as a control whose cylindrical casing body had a inner diameter of 1,800 mm. Various factors associated with the air classifiers used in the examples are set forth in Table 2 below.

TABLE 2

| Factors of air classification | Sample A1 (Example) | B1 (Example) | C1 (Example) | D1 (Example) | E1 (Control) |
|---|---|---|---|---|---|
| Inclination angle of guide vanes (degrees of angle) | 5 | 10 | 8 | 7 | |
| Number of classification chambers | 1 | 1 | 3 | 3 | Ordinary cyclone used as a control |
| Number of vortical flow-adjusting blades | — | 8 | 8 | 8 | |
| Positions of vortical flow-adjusting blades | — | INT | OE | OE | |
| Centrifugal effect of the rotary disc member | 220 | 140 | 190 | 240 | |
| Secondary air | None | None | None | None | |
| Tertiary air | None | None | None | Used | |

Sample air classifiers A1, B1, C1, D1 were operated under the following conditions:

Supplied amount of powder raw material: 28 t/h

Concentration of powder material: 0.57 Kg/m$^3$ Classification was carried out to the extent that a value denoting an amount of fine powder retained on a 100 micron sieve substantially stood at 1.0%.

"OE" given in Table 2 above represents an air classifier wherein the peripheral edge of the rotary disc member 8 was fitted with equidistantly arranged vortical flow-adjusting blades 19. "INT" shown in Table 2 above denotes an air classifier wherein equidistantly arranged vortical flow-adjusting blades 19 were disposed slightly inward from the peripheral edge of the rotary disc member 8.

The centrifugal effect of the rotary disc member was determined from $V_T^2/rg$ (where $V_T$ is a peripheral speed of the rotatary disc member; r is a distance from the center of the classification chamber to the outer perephery of the rotary disc member; g shows the acceleration of a gravitational force). The rotary disc member 8 was rotated in the same direction as that in which air streams were let to flow (clockwise of FIG. 1).

The percentage recovery of fine powder passing through the 100 micron sieve toward the fine product and an amount of fine powder retained on the 100 micron sieve are set forth in Table 3 below.

TABLE 3

| | Sample A1 (Example) | B1 (Example) | C1 (Example) | D1 (Example) | E1 (Control) |
|---|---|---|---|---|---|
| Percentage recovery of fine powder passing through a 100 micron sieve toward the fine product | 70 | 82 | 88 | 95 | 25 |
| Percentage residue of fine powder retained on the 100 micron sieve | 0.3 | 0.2 | 0.2 | 0.1 | 1.1 |

EXAMPLE 2

A mixture of cement powder and air recovered from a cement mill using air sweeping process was used as a raw material of classification. This raw material had a powder size distribution as shown in Table 4 below.

TABLE 4

| | | | | | | |
|---|---|---|---|---|---|---|
| Particle size (micrometers) | 10 | 15 | 30 | 50 | 100 | 200 |
| Weight percentage of sieve residue | 83.7 | 79.2 | 65.0 | 49.5 | 24.5 | 6.5 |

The air classifiers of FIGS. 1 to 4 fitted with the arrangement of FIG. 10 were used in the experiments. Various factors associated with the classification of cement powder were the same as those used in Example 1. A dispersion air separator equipped with external cyclones and circulation fan and so-called cyclone type air separator widely accepted in the cement-manufacturing industry was used as a control. The classification chamber of the air classifier used as the control had a diameter of 3,800 mm. Various factors associated with the air classifiers used in the examples are shown in Table 5 below.

TABLE 5

| Factors of air classification | Sample classifiers A2 (Example) | B2 (Example) | C2 (Example) | D2 (Example) | E2 (Control) |
|---|---|---|---|---|---|
| Inclination angle of guide blades (degrees of angle) | 5 | 9 | 7 | 6 | |
| Number of classification of chambers | 1 | 1 | 3 | 3 | A cyclone type air separator was used as a control |
| Number of vortical flow-adjusting blades | — | 8 | 8 | 8 | |
| Position of vortical flow-adjusting blades | — | INT | OE | OE | |
| Centrifugal effect of the dispersion member of the rotary disc | 240 | 190 | 220 | 270 | |
| Secondary air | None | None | None | None | |
| Tertiary air | None | None | None | Used | |
| Supplied amount of powder raw material M(t/h) | 20 | 20 | 20 | 20 | |
| Supplied amount of powder raw material N(t/h) | 25 | 25 | 25 | 25 | |

All the sample air separators A2, B2, C2, D2, E2 were carried out the classification of a powder raw material in such a manner that with the powder material concentration in the air classifier set at 1.1 Kg/m$^3$, a value denoting a target amount of powder of the powder material retained on a 100 micron sieve substantially indicated 1.0%. In control E2, powder raw material was supplied at the rate of 160 t/h. A supplied amount M of powder raw material (cement) denotes that which was introduced through the air-powder material inlet duct 4. A supplied amount N of powder raw material represents that which was taken in through the powder raw material inlet duct 28.

The percentage recovery of fine powder passing through a 100 micron sieve toward the fine product, the percentage residue of fine cement powder retained on the 100 micron sieve, and the percentage of partition toward the return are all set forth in Table 6 below.

TABLE 6

| | Sample | | | | |
|---|---|---|---|---|---|
| | A2 (Example) | B2 (Example) | C2 (Example) | D2 (Example) | E2 (Control) |
| Percentage recovery of fine powder passing through a 100 micron sieve toward the fine product | 52 | 57 | 63 | 69 | 49 |
| Percentage residue of fine powder retained on the 100 micron sieve | 1.4 | 0.8 | 0.5 | 0.3 | 1.4 |
| Percentage of partition toward the return | 7 | 5 | 3 | 1.2 | 19 |

The results of classifying a powder raw material in Examples 1 and 2 are respectively shown in FIGS. 14 and 15, which indicate the classifying characteristics of the air classifiers used in Examples 1 and 2, and in which the abscissa shows the particle sizes and the ordinates indicates the weight-percentage of the powder classified into fine product. As used herein, the weight percentage of the powder classified into fine product is defined to mean the ratio of the amounts of powder in fine product belonging to the respective grain size divisions to the total amount of said particle size division in the classifier-feed.

An apparent from FIGS. 14 and 15, the air separators A1, B1, C1, D1, A2, B2, C2, D2 embodying this invention all indicate sharper classification characteristic curves than the ordinary cyclone E1 and cyclone type air separator E2, that is, effecting the classification of a raw powder cement with higher accuracy. In other words, the air classifier of this invention prevents coarse powder from being carried into fine powder or vice versa, thereby ensuring a higher recovery of fine powder, that is, higher accuracy and efficiency of classification than any of the conventional air classifiers.

It is very difficult to draw a sharp line of distinction between the properties of the air classifiers A1, B1, C1, D1, A2, B2, C2 and D2, because more or less it depends on the conditions of classification. However, the air classifiers D1, D2 which are provided with vortical flow-adjusting blades, a relatively larger number of classification chambers and tertiary air inlet duct carry out classification most satisfactorily.

It is understood that percentage recovery of fine powder passing through a 100 μm sieve toward the fine product means the ratio of the amount of fine powder passing through a 100 μm sieve contained in the fine product to the amount of fine powder passing through a 100 μm sieve contained in the classifier-feed. Percentage of partition toward the return means the ratio of the amount of particles which have not received the classifying action and have directly been led into the return to the total amount of classifier-feed.

What we claim is:

1. An air classifier which comprises:

a casing formed of a generally hollow cylindrical vertical casing body and a hopper fitted to the lower end of said casing body;

a fine product outlet duct set at the center of the upper end wall of the casing body;

an air-powder raw material inlet duct tangentially projecting outward from the casing body;

a rotary shaft concentrically extending through the casing body;

a rotary disc member concentrically fixed in the casing body and set at a boundary between the casing body and the hopper to concurrently carry out the dispersion and classification of a powdered material; and guide vanes provided in the casing body in a state equidistantly spaced from each other in the circumferential direction of said casing body to conduct a mixture of air and a powder raw material into said casing.

2. The air separator according to claim 1, further comprising vortical flow-adjusting blades mounted on the rotary disc member in said casing body in a state set in parallel with the rotary shaft and substantially equidistantly spaced from each other in the circumferential direction of the rotary disc member.

3. The air separator according to claim 2, further comprising at least one ring-shaped horizontal partition member fitted to the vortical flow-adjusting blades in the casing body in a concentric relationship with the rotary shaft.

4. The air classifier according to claim 1, wherein another fine product outlet extends downward from the rotary disc member in a concentric relationship therewith and project out of the hopper; and the rotary disc is provided with openings through which said another fine product outlet ducts communicate with the casing body.

5. The air classifier according to claim 4, wherein another horizontal rotary disc member is provided concentrical with the rotary shaft above the first-mentioned rotary disc member.

6. The air classification according to claim 5, further comprising vortical flow-adjusting blades which are fixed to said both rotary disc members in a state set in parallel with the rotary shaft and equidistantly spaced from each other in the circumferential direction of the rotary disc members.

7. The air classifier according to claim 6, further comprising at least one ring-shaped horizontal partition member fixed to the vortical flow-adjusting blades concentrical with the rotary shaft in each of the spaces above and below said another rotary disc member.

8. The air classifier according to any one of the preceding claims, wherein additional powder raw material inlet ducts are provided on the upper wall of the casing body at substantially the same distance from the rotary shaft and in a state equidistantly spaced from each other; and a horizontal circular dispersion member is fixed to the rotary shaft in the lower region of the additional powder raw material inlet ducts to disperse a powdered raw material outward in the radial direction of the casing body.

9. The air classifier according to claim 8, further comprising in the casing body a buffer which surrounds the dispersion member and the inner wall of which defines a truncated conical shape.

10. The air classifier according to claim 8, wherein the rotary disc member has an appreciably flattened trancated conical surface.

11. The air classifier according to claim 8, wherein adjustable dampers are inserted into the fine product outlet duct.

12. The air classifier according to claim 8, wherein the guide blades have a variable inclination angle.

13. The air classifier according to claim 8, further comprising a secondary air inlet duct extending tangentially outward from a portion of the lateral wall of the casing body which is disposed opposite to the air-powder raw material inlet duct.

14. The air classifier according to claim 8, further comprising tertiary air inlet ducts extending outward from the hopper.

15. An air classifier which comprises:

a casing formed of a generally hollow cylindrical vertical casing body and a hopper fitted to the lower end of said casing body;

a fine product outlet duct set at the center of one of horizontal end walls of the casing body;

an air-powder raw material inlet duct tangentially projecting outward from the casing body;

a rotary shaft concentrically extending through the casing body;

a rotary disc member concentrically fixed in the casing body to concurrently carry out the dispersion and classification of a powder material;

guide vanes provided in the casing body in a state equidistantly spaced from each other in the circumferential direction of said casing body to conduct a mixture of air and a powder raw material into said casing;

additional powder raw material inlet ducts provided on the upper wall of the casing body at substantially the same distance from the rotary shaft and in a state equidistantly spaced from each other; and a horizontal circular dispersion member fixed to the rotary shaft in the lower region of the additional powder raw material inlet ducts to disperse a powdered raw material outward in the radial direction of the casing body.

16. The air separator according to claim 15, further comprising vortical flow-adjusting blades mounted on the rotary disc member in said casing body in a state set in parallel with the rotary shaft and substantially equidistantly spaced from each other in the circumferential direction of the rotary disc member.

17. The air separator according to claim 16, further comprising at least one ring-shaped horizontal partition member fitted to the vortical flow-adjusting blades in the casing body in a concentric relationship with the rotary shaft.

18. The air classifier according to claim 15, further comprising in the casing body a buffer which surrounds the dispersion member and the inner well of which defines a truncated conical shape.

19. The air classifier according to claim 15, wherein the rotary disc member has an appreciably flattened truncated conical surface.

20. The air classifier according to claim 15, wherein adjustable dampers are inserted into the fine product outlet duct.

21. The air classifier according to claim 15, wherein the guide blades have a variable inclination angle.

22. The air classifier according to claim 15, further comprising a secondary air inlet duct extending tangentially outward from a portion of the lateral wall of the casing body which is disposed opposite to the air-powder raw material inlet duct.

23. The air classifier according to claim 15, further comprising tertiary air inlet ducts extending outward from the hopper.

24. An air classifier which comprises:

a casing formed of a generally hollow cylindrical vertical casing body and a hopper fitted to the lower end of said casing body;

a fine product outlet duct set at the center of one of horizontal end walls of the casing body;

an air-powder raw material inlet duct tangentially projecting outward from the casing body;

a rotary shaft concentrically extending through the casing body;

a rotary disc member concentrically fixed in the casing body to concurrently carry out the dispersion and classification of a powder material, said rotary disc member provided with at least one opening through which the fine product outlet duct communicates with the casing body said fine product outlet duct extending downward from the rotary disc member a concentric relationship therewith to project out of the hopper;

guide vanes provided in the casing body in a state equidistantly spaced from each other in the circumferential direction of said casing body to conduct a mixture of air and a powder raw material into said casing;

vortical flow-adjusting blades mounted on the rotary disc member in the casing body in a state set in parallel with the rotary shaft and substantially equidistantly spaced from each other in the circumferential direction of the rotary disc member;

a powered material inlet duct provided at the center of the upper wall of the casing body; and a disc-like horizontal dispersion member fixed to the upper ends of the vortical flow-adjusting blades concentrically with the rotary shaft.

25. The air classifier according to claim 24, further comprising in the casing body a buffer member which surrounds the dispersion member and inner wall of which defines a truncated conical shape.

26. The air classifier according to claim 25, wherein at least one ring-shaped horizontal partition member is fixed to the vortical flow-adjusting blades in the casing body in a concentric relationship with the rotary shaft.

27. The air classifier according to claim 24, wherein the rotary disc member has an appreciably flattened truncated conical shape.

28. The air classifier according to claim 24, wherein adjustable dampers are inserted into the fine product outlet duct.

29. The air classifier according to claim 24, wherein the guide blades have a variable inclination angle.

30. The air classifier according to claim 24, further comprising a secondary air inlet duct extending tangentially outward from a portion of the lateral wall of the casing body which is disposed opposite to the air-powder raw material inlet duct.

31. The air classifier according to claim 24, further comprising tertiary air inlet ducts extending outward from the hopper.

* * * * *